United States Patent [19]

White et al.

[11] 4,330,420

[45] May 18, 1982

[54] LOW ASH, LOW PHOSPHORUS MOTOR OIL FORMULATIONS

[75] Inventors: William R. White; John Reale, Jr., both of Wappingers Falls, N.Y.

[73] Assignee: Texaco Inc., Del.

[21] Appl. No.: 281,637

[22] Filed: Jul. 9, 1981

Related U.S. Application Data

[63] Continuation-in-part of Ser. No. 149,401, May 13, 1980, abandoned.

[51] Int. Cl.[3] ..... C10M 1/48

[52] U.S. Cl. ..... 252/32.7 E; 252/33.2; 252/33.4

[58] Field of Search ..... 252/32.7 E, 33.2, 33.4

[56] References Cited

U.S. PATENT DOCUMENTS

| | | | |
|---|---|---|---|
| 3,522,180 | 7/1970 | Sweeney et al. | 585/12 |
| 3,578,595 | 5/1971 | Schlicht et al. | 252/32.7 E X |
| 3,897,353 | 7/1975 | Mordouchowitz et al. | 252/56 R X |
| 4,010,106 | 3/1977 | Rothert | 252/32.7 E |
| 4,045,376 | 8/1977 | Rubin et al. | 252/56 R X |
| 4,148,738 | 4/1979 | Liston et al. | 252/32.7 E |

OTHER PUBLICATIONS

"Lubricant Additives" Smalheer et al., pp. 1-11, 1967, The Lezius-Hiles Co.

*Primary Examiner*—Andrew Metz

*Attorney, Agent, or Firm*—Carl G. Ries; Robert A. Kulason; Henry W. Archer

[57] ABSTRACT

Described are low ash, low phosphorus motor oils having improved oxidation stability as a result of the addition thereto of synergistic amounts of a dialkyldiphenylamine antioxidant and of a sulfurized polyolefin. The synergism between the two additives compensates for the decreased amounts of phosphorus in the form of zinc dithiophosphate such that the oils retain an SE quality rating.

12 Claims, No Drawings

LOW ASH, LOW PHOSPHORUS MOTOR OIL FORMULATIONS

CROSS-REFERENCE TO CO-PENDING APPLICATION

This application is a continuation-in-part of co-pending application Ser. No. 149,401, filed May 13, 1980 and now abandoned.

BACKGROUND OF THE INVENTION

1. Field of the Invention

This invention relates generally to motor oils and more particularly to low cost, low ash and low phosphorus lubricating oil formulations 2. Statement of the Prior Art Sulfurized isobutylene and polyisobutylene such as di- and triisobutylene have long been known as additives for lubricating oils. They are in reality a complex mixture of products theorized to be principally 4,5-dialkyl-1,2-dithiole-3-thione and minor amounts of sulfides, polymeric sulfur-substituted compounds and mercaptans.

With the recent trend toward low-ash, low-phosphorus motor oils for improved catalyst efficiency, future motor oil formulations will be required which contain little or no phosphorus and the minimum amount of metallic additives. In Japan, this requires that the traditional amount of zinc dithiophosphate (ZDTP) in a motor oil be reduced to values of about 0.05%P and in the U.S. some car manufacturers will require phosphorous levels of 0.05% by 1985.

As reported by Torii, Kyozo et al "Anti-Wear Properties of Engine Oils-Effects of Oil Additives on Valve Train Wear" SAE Fuels & Lubes Meeting 6/7-9, 1977; this small amount of ZDTP appears to give acceptable wear control but places an additional demand on the lubricant in terms of oxidation control. SE quality motor oils cannot be economically developed using only the traditional phenolic or diphenylamine antioxidants in combination with the small amount of ZDTP, since even large amounts of the phenolic and diphenylamine antioxidants fail to give acceptable oxidation control in the Sequence IIIC Engine Test. Apparently, this is caused by an imbalance of the ZDTP/diphenylamine or phenolic synergism reported by Scott, Gerald "Atmospheric Oxidation and Anti-Oxidants" Elsevier Publishing Co., New York, 1965, at page 272.

Relevant patents in this field include U.S. Pat. Nos. 3,673,090, 2,995,569, 3,578,595, 3,897,353, 4,010,106, and 4,148,738. None of these hint or suggest in any manner applicants' unobvious combination of additives.

SUMMARY OF THE INVENTION

The invention provides low ash, low phosphorus motor oil formulations and additive packages for such formulations containing synergistic amounts of sulfurized polyolefin antioxidants which compensate for decreased amounts of phosphorus in the form of zinc dithiophosphate and exhibit the required synergism with another oxidant, a dialkyldiphenylamine such that SE quality motor oils with low phosphorus content are produced. The same oxidation stability cannot be achieved by merely adding more diphenylamine.

DESCRIPTION OF THE PREFERRED EMBODIMENTS AND BEST MODE

The fully formulated motor oils according to the invention comprise in weight percents 2 to 10% of an ashless dispersant, preferably, an alkenylsuccinimide derived from triethylene tetramine and alkenylsuccinic anhydride having a Sap No. of 55 and made in a thermal reaction from polyisobutylene of about 1300 mol weight; 0.5 to 5% of a magnesium or calcium salt such as their acetates, sulfates; sulfonates, carbonates and mixtures thereof sufficient to provide at least 0.1% of magnesium or calcium or a mixture thereof; from 0.5–2.0 weight % of zinc dialkyl dithiosphate; from 0.2 to 2.0% of a dialkyldiphenylamine antioxidant; from 0.2 to 4% of a sulfurized polyolefin antioxidant; from 2 to 10% of a first, ethylene propylene VI improver; from 2% to 10% of a second VI Improver consisting of methacrylate terpolymer; from 75 to 95% of a hydrocarbon naphthenic and paraffinic based oil having an SUS viscosity between about 100 and 750 at 100° F.

To illustrate the successful practice of this invention oil, fully formulated motor oils A-F were blended with the constituents tabulated below in Tables I and II.

Table I shows the synergism between the sulfurized polyolefins and the dialkyldiphenylamine by means of the conventional Differential Scanning Calorimetry Tets (DSC) wherein the higher time to Δ H maximum value, the greater an oil's oxidation stability. Thus comparing oil A which contains both dialkyl diphenyl amine antioxidant and the diisobutylene polysulfides with oil B which contains only the latter, there will be noted a figure of 55 minutes versus only 23 minutes for the single antioxidant package. Comparing oil A with oil C which has only dialkyldiphenylamine the figure of 55 minutes is contrasted with only 29.5 minutes for the latter. In the three packages the amount of phosphorus is only 0.05%, which is the reduced content desired.

TABLE I

| Composition Wt. % | A | B | C |
|---|---|---|---|
| Alkenyl-succinimide | 5.91 | 5.91 | 5.91 |
| Magnesium salt | 1.01 | 1.01 | 1.01 |
| ZDTP | 0.52 (.05%P) | 0.52 (.05%P) | 0.52 (.05%P) |
| Dialkyl-diphenyl-amine antioxidant | 0.53 | — | 0.53 |
| Antioxidant[1] | 0.40 | 0.40 | — |
| VI Improver[2] | 6.25 | 6.25 | 6.25 |
| VI Improver[3] | 4.25 | 4.25 | 4.25 |
| Base Oil[4] | 81.13 | 81.66 | 81.53 |
| DSC (isothermal 175° C.-500 lbs./$O_2$) Time to Δ H Max, (min.) | 55 | 23.0 | 29.5 |

[1]Mixture of diisobutylene polysulfides the reaction product of sulfur and diisobutylene (2/1 mole ratio) containing about 39–42% weight sulfur of which about 37–38% weight is "active" sulfur.

[2]20,000 to 50,000 mw e/p copolymer containing 30–50 mole percent propylene.

[3]Terpolymer of butyl methacrylate, lauryl methacrylate and stearyl methacrylate in a weight ratio of 40/30/30 basis monomers.

[4]Base oil had an SUS viscosity of 150 at 100° F.

TABLE II

| Composition Wt. % | D | E | F |
|---|---|---|---|
| Alkenyl-succinimide | 7.07 (0.065 %N) | 5.91 (0.065 %N) | 5.68 (0.060 %N) |
| Magnesium salt | 1.01 (0.10 %Mg) | 1.01 (0.10 %Mg) | 1.01 (0.10 %Mg) |
| ZDTP | 0.48 (0.05 %P) | 0.52 (0.05 %P) | 0.53 (0.05 %P) |
| Dinonyldiphenylamine antioxidant | 0.63 | 0.35 | 0.46 |
| Antioxidant[1] | — | 0.75 | 1.18 |
| VI Improver[2] | 5.80 | 6.25 | 6.25 |
| VI Improver[3] | 4.10 | 4.25 | 4.25 |
| Base Oil[4] | 80.91 | 80.96 | 80.64 |
| Sequence IIIC Engine Test % Viscosity Increase 40 hours | 1,650.0 243.5 | 31.5 | |

[1]Mixture of diisobutylene polysulfides, the reaction product of sulfur and diisobutylene (2/1 mole ratio) containing about 39-42% weight sulfur of which about 37-38% weight is "active" sulfur.
[2]20,000 to 50,000 mw e/p copolymer containing 30-50 mole percent propylene.
[3]Terpolymer of butyl methacrylate, lauryl methacrylate and stearyl methacrylate in a weight ratio of 40/30/30 basis monomers.
[4]Base oil had an SUS viscosity of 150 at 100° F.

Fully formulated motor oils D, E and F were also evaluated in the Sequence IIIC Engine Test.

For this test, a 1961 Oldsmobile V8 engine is operated continuously for 64 hours under conditions of moderately high speed and load, very high jacket coolant temperature, and lean air-fuel ratio. Every eight hours an oil sample is taken and checked for viscosity at 100° F., the 8 hour used oil samples are used to determine the percent viscosity increase versus time pattern for the oil. In addition the engine is disassembled and rated for sludge, piston varnish and valve train wear. The lower the value, the better the result. The maximum allowed viscosity increase after 40 hours is 400%. As shown in Table II, only oils E and F which contained both dialkyldiphenylamine and the diisobutylene polysulfides passed the test while D which only contained the dinonyldiphenylamine failed.

In other tests, a standard motor oil was employed which has an SUS viscosity of 150 at 100° F. To this standard motor oil there was added 0.50 weight percent of a dialkyldiphenylamine antioxidant (Experiment G). In Experiment H, there was added to the oil 0.50 weight percent of the diisobutylene polysulfide (sulfurized polyolefin) antioxidant. For Experiment I, there was added 0.25 weight percent of each of the additives used in Experiments G and H.

The compositions of each of the above experiments were evaluated by means of the conventional Differential Scanning Calorimetry Test (DSC) wherein the higher time to a Δ H maximum value signifies the greater oxidation stability of an oil. The results are tabulated in Table III.

TABLE III

| Composition Wt. % | G | H | I |
|---|---|---|---|
| Alkenyl-succinimide | 5.91 | 5.91 | 5.91 |
| Magnesium salt | 1.01 | 1.01 | 1.01 |
| ZDTP[4] | 0.52 (0.05%P) | 0.52 (0.05%P) | 0.52 (0.05%P) |
| Dialkyl-diphenyl-amine antioxidant | 0.50 | — | 0.25 |
| Antioxidant[1] | — | 0.50 | 0.25 |

TABLE III-continued

| Composition Wt. % | G | H | I |
|---|---|---|---|
| VI Improver[2] | 6.25 | 6.25 | 6.25 |
| VI Improver[3] | 4.25 | 4.25 | 4.25 |
| Base Oil | 81.56 | 81.56 | 81.56 |
| DSC (isothermal 175° C.-500 lbs./$O_2$) time To Δ H Max. (min.) | 33 | 28 | 91 |

[1]Mixture of diisobutylene polysulfides, the reaction product of sulfur and diisobutylene (2/1 mole ratio) containing about 39-42% weight sulfur of which about 37-38% weight is "active" sulfur.
[2]20,000 to 50,000 mw e/p copolymer containing 30-50 mole percent propylene.
[3]Terpolymer of butyl methacrylate, lauryl methacrylate and stearyl methacrylate in a weight ratio of 40/30/30 basis monomers.
[4]Zinc dithiophosphate.

From an inspection of Table III, it will be apparent that:

a. If one adds 0.50 weight percent of a dialkyldiphenylamine antioxidant to a base oil (containing conventional additives) the measured value from the DSC Test is 33 minutes.

b. If one adds 0.50 weight percent of a sulfurized polyolefin to the same oil the DSC test result is 28 minutes.

c. If, however, one adds only 0.25 weight percent of each of the above additives, the DSC test result is 91 minutes. This figure is more than double the values obtained with 0.50 weight percent of each additive used alone.

The data of Tables I, II and III demonstrate the unobvious and unpredictable synergistic behavior of the dialkyldiphenylamine antioxidant with the sulfurized polyolefin and the surprising reduction in phosphorus achieved thereby.

It is not intended that this invention be limited to the specific examples or modifications which have been given merely for the sake of illustration nor unnecessarily by any theory as to the mechanism of the operation of the invention but only by the appended claims which include all novelty inherent in the invention.

What we claim is:

1. A motor oil comprising:

about 2 to 10 weight percent of an alkenylsuccinimide dispersant;

about 0.5 to about 5 weight percent of magnesium or calcium, acetate, sulfonate, sulfate, carbonate and mixtures thereof;

about 0.5 to about 2.0 weight percent of a zinc dialkyl dithiophosphate;

about 0.2 to 2.0 weight percent of a dialkyldiphenylamine antioxidant;

about 0.2 to 4.0 weight percent of a sulfurized polyolefin antioxidant;

about 2 to about 10 weight percent of a first VI improver consisting of an ethylene-propylene copolymer;

from about 2 to about 10 weight percent of a second VI improver consisting of a methacrylate terpolymer;

the balance a hydrocarbon base oil.

2. The oil of claim 1, wherein said dialkyldiphenylamine is 4,4' dinonyldiphenylamine.

3. The oil of claim 1, wherein said sulfurized polyolefin is a mixture of diisobutylene polysulfides.

4. The oil of claim 1, wherein said first VI improver is a 20,000 to 50,000 mw e/p copolmer containing 30 to 50 mole percent of propylene.

5. The oil of claim 1, wherein said second VI improver is a terpolymer of butyl methacrylate, lauryl methacrylate and stearyl methacrylate in a weight ratio of 40/30/30, basis monomers.

6. The oil of claim 1, wherein said lubricating oil has an SUS viscosity between about 100 and 750 at 100° F.

7. An additive package for a motor oil comprising from about 4 to 10 weight percent of an alkenyl succinimide dispersant; about 0.5 to about 1.5 weight percent of magnesium or calcium acetate, sulfonate, sulfate, carbonate and mixtures thereof;

about 0.5 to about 2.0 weight percent of a zinc dialkyldithiophosphate; about 0.2 to 2.0 weight percent of a dialkyldiphenylamine antioxidant; about 0.2 to 4.0 weight percent of a sulfurized polyolefin antioxidant; about 2 to about 10 weight percent of a first VI improver consisting of an ethylene/propylene copolymer; and from about 2 to about 10 weight percent of a second VI improver consisting of a methacrylate terpolymer.

8. The package of claim 7, wherein said dialkyldiphenylamine is 4,4′ dinonyldiphenylamine.

9. The package of claim 7, wherein said sulfurized polyolefin is a mixture of diisobutylene polysulfides.

10. The package of claim 7, wherein said first VI improver is a 20,000 to 50,000 MW ethylene/propylene copolymer containing 30 to 50 mole percent of propylene.

11. The package of claim 7, wherein said second VI improver is a terpolymer of butyl methacrylate, lauryl methacrylate and stearyl methacrylate in a weight ratio of 40/30/30, basis monomers.

12. The package of claim 7, wherein said sulfurized polyolefin antioxidant is the reaction product of sulfur and diisobutylene in a 2:1 mole ratio containing about 39 to 42 percent by weight of sulfur.

* * * * *